US007908675B2

(12) United States Patent
Robinson

(10) Patent No.: US 7,908,675 B2
(45) Date of Patent: Mar. 22, 2011

(54) MULTI-POCKET SYSTEM FOR PANTS

(76) Inventor: Steven J Robinson, Syosset, NY (US)

( * ) Notice: Subject to any disclaimer, the term of this patent is extended or adjusted under 35 U.S.C. 154(b) by 487 days.

(21) Appl. No.: 12/122,148

(22) Filed: May 16, 2008

(65) Prior Publication Data

US 2009/0282600 A1 Nov. 19, 2009

(51) Int. Cl.
*A41D 27/20* (2006.01)

(52) U.S. Cl. ..... 2/247; 2/248

(58) Field of Classification Search ..... 2/247, 248, 2/249, 250, 251, 252, 253, 254, 267, 86; 224/676, 677, 682, 683; 383/41, 210.1
See application file for complete search history.

(56) References Cited

U.S. PATENT DOCUMENTS

| | | | | |
|---|---|---|---|---|
| 1,708,786 | A * | 4/1929 | Cohen | 2/247 |
| 2,501,338 | A | 3/1950 | Kass | |
| 2,967,307 | A | 1/1961 | O'Donnell | |
| D221,327 | S | 8/1971 | Watts et al. | |
| 4,613,991 | A | 9/1986 | Grover | |
| 4,651,348 | A | 3/1987 | Swanson | |
| 4,993,844 | A | 2/1991 | Robinson et al. | |
| 5,072,456 | A | 12/1991 | Elin | |
| 5,509,147 | A | 4/1996 | Busquets | |
| 5,678,250 | A | 10/1997 | Nolan | |
| D396,135 | S | 7/1998 | Wardle | |
| D405,237 | S | 2/1999 | Maslowski | |
| 5,884,338 | A | 3/1999 | Golde | |
| 6,397,392 | B1 * | 6/2002 | Wooley et al. | 2/102 |
| 6,421,839 | B1 | 7/2002 | Vo et al. | |
| D542,009 | S | 5/2007 | Wardle et al. | |
| D543,009 | S | 5/2007 | Helbing et al. | |
| D543,337 | S | 5/2007 | Wardle | |
| D545,529 | S | 7/2007 | Helbing et al. | |
| 2008/0216212 | A1 * | 9/2008 | Burgess et al. | 2/228 |

* cited by examiner

*Primary Examiner* — Gary L Welch
*Assistant Examiner* — Alissa J Tompkins
(74) *Attorney, Agent, or Firm* — Dickinson Wright PLLC

(57) ABSTRACT

A multi-pocket assembly attachable to a garment and more particularly to a multipocket system for pants that allows easy access even when a user is in a seated position. One embodiment provides has a first pocket structure having an interior access opening with means for closing the top and at least one vertical side. Additional pockets can be added on top of the first pocket. Additional features that can be added to the invention include reflective tape, securable flaps, zippers, pleats, and the like.

12 Claims, 11 Drawing Sheets

MULTI-POCKET SYSTEM FOR PANTS

CLAIM OF PRIORITY

This application claims priority to U.S. Design patent application Ser. No. 29/305,714, filed on Mar. 26, 2008, the contents of which are herein incorporated by reference in their entirety.

FIELD OF THE INVENTION

The present invention generally relates to multi-pocket systems and more particularly to a multi-pocket system for pants that allows easy access even when a user is in a seated position through multiple access points to the same pocket.

BACKGROUND OF INVENTION

Several types multi-pocket configurations exist in the art. Several of these are for specific or specialty uses and configured for a variety of different types of documents or articles. (see generally U.S. Pat. No. 5,884,338 to Golde). While these various types of pocketed garments appear to work satisfactorily for their intended purpose, they fail to provide desired pocketing for pants, especially when a user is in a seated position.

For example, many individuals that must remain seated for extended periods of time in sometimes cramped quarters often have difficulty accessing the contents of their pockets. An international airline traveler who needs to access boarding passes, immigration forms, passports, and the like would have difficulty accessing these documents prior to landing and being able to stand up. A similar situation exists for an individual seated in an automobile with their seatbelt fastened. U.S. Pat. No. 5,509,147 attempts to address the problems facing a seated traveler by placing a multi-pocket configuration on a shirt. Unfortunately, this configuration is rather complicated and would require the discomfort of have several uncomfortable items in your shirt pocket for extended periods of time.

Thus, there is a desire and a need in the art to provide a simple multi-pocket configuration that is suitable for application on pants and allow equal ease of access to pocket contents whether a user is seated or standing.

SUMMARY OF INVENTION

Accordingly, the present invention provides a multi-pocket assembly attachable to a garment and more particularly to a multi-pocket system for pants that allows easy access even when a user is in a seated position through multiple access points to the same pocket.

In one embodiment for the present invention, the multi-pocket assembly has a a first pocket structure having a front, a top side, a bottom side, and two vertical sides, said first pocket structure having at least two interior access openings with means for closing on said topside and at least one of said vertical sides; a second pocket structure attached to the front of said first pocket, having a second front, second vertical sides, second bottom side, and second top side, having an second interior access opening on the second top side, and a flap to cover said second interior access opening; and a third pocket structure attached to the front of said second pocket, having a third top side, third vertical sides, third bottom side, having an third interior access opening on the third top side, and a second flap to cover said third interior access opening, said third pocket structure smaller in size to said second pocket structure. As illustrated the invention can be practiced on a pant leg, though a variety of garments known in the art could be used.

Additional features that can be added to the invention include reflective tape, securable flaps, zippers, pleats, and the like.

Other features of the present invention will become more apparent to persons having ordinary skill in the art to which the present invention pertains from the following description and claims.

BRIEF DESCRIPTION OF THE FIGURES

The foregoing features, as well as other features, will become apparent with reference to the description and figure below, in which like numerals represent elements and in which.

DETAILED DESCRIPTION OF THE INVENTION

The present invention provides a multi-pocket system or assembly and more particularly to a multi-pocket system for pants that allows easy access even when a user is in a seated position through multiple access points to the same pocket. This makes the pocket extremely useful for a seat-belted user sitting for an extended period of time, such as in an automobile or an airplane.

Figure 1:
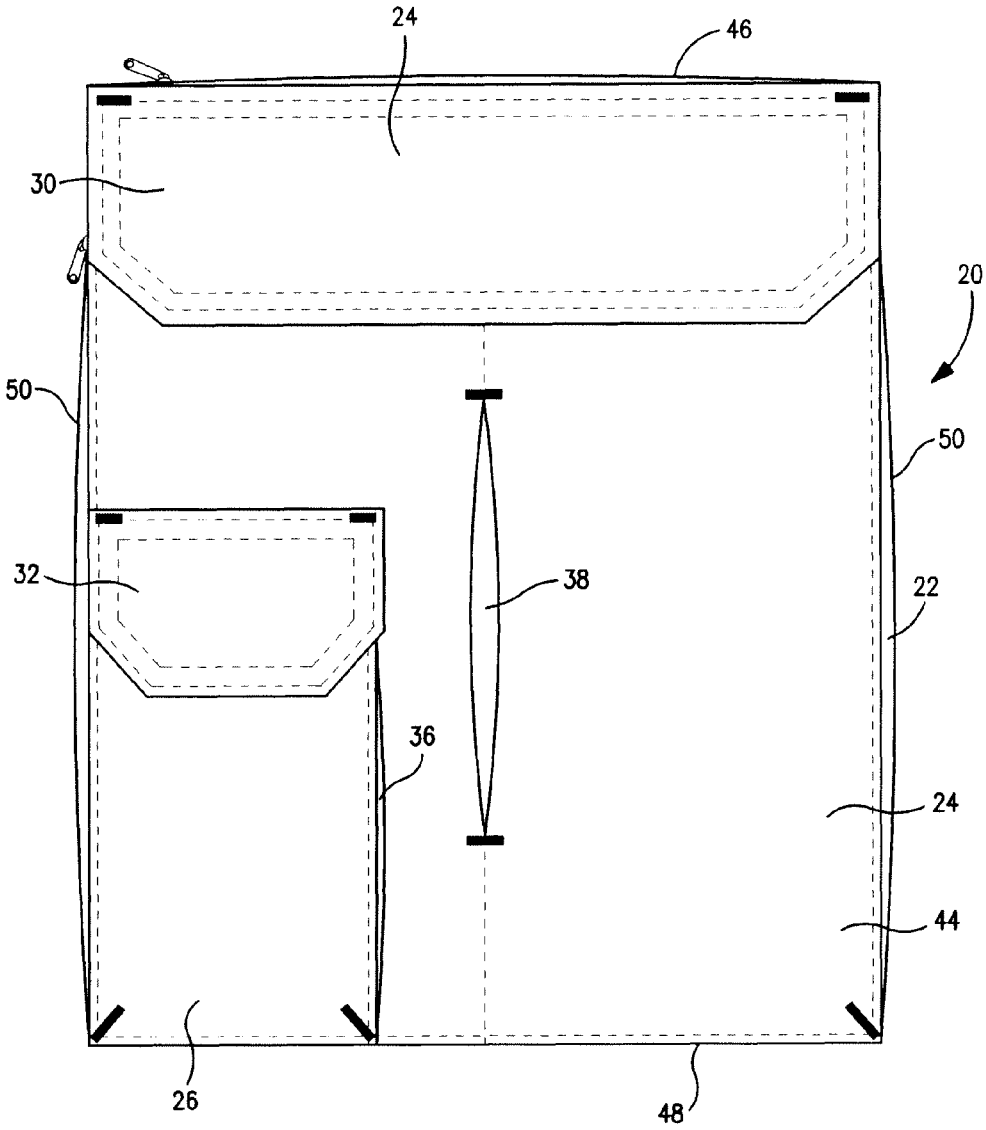
FIG. 1 is a front view of a pocket of one embodiment of the present invention.
Figure 2:
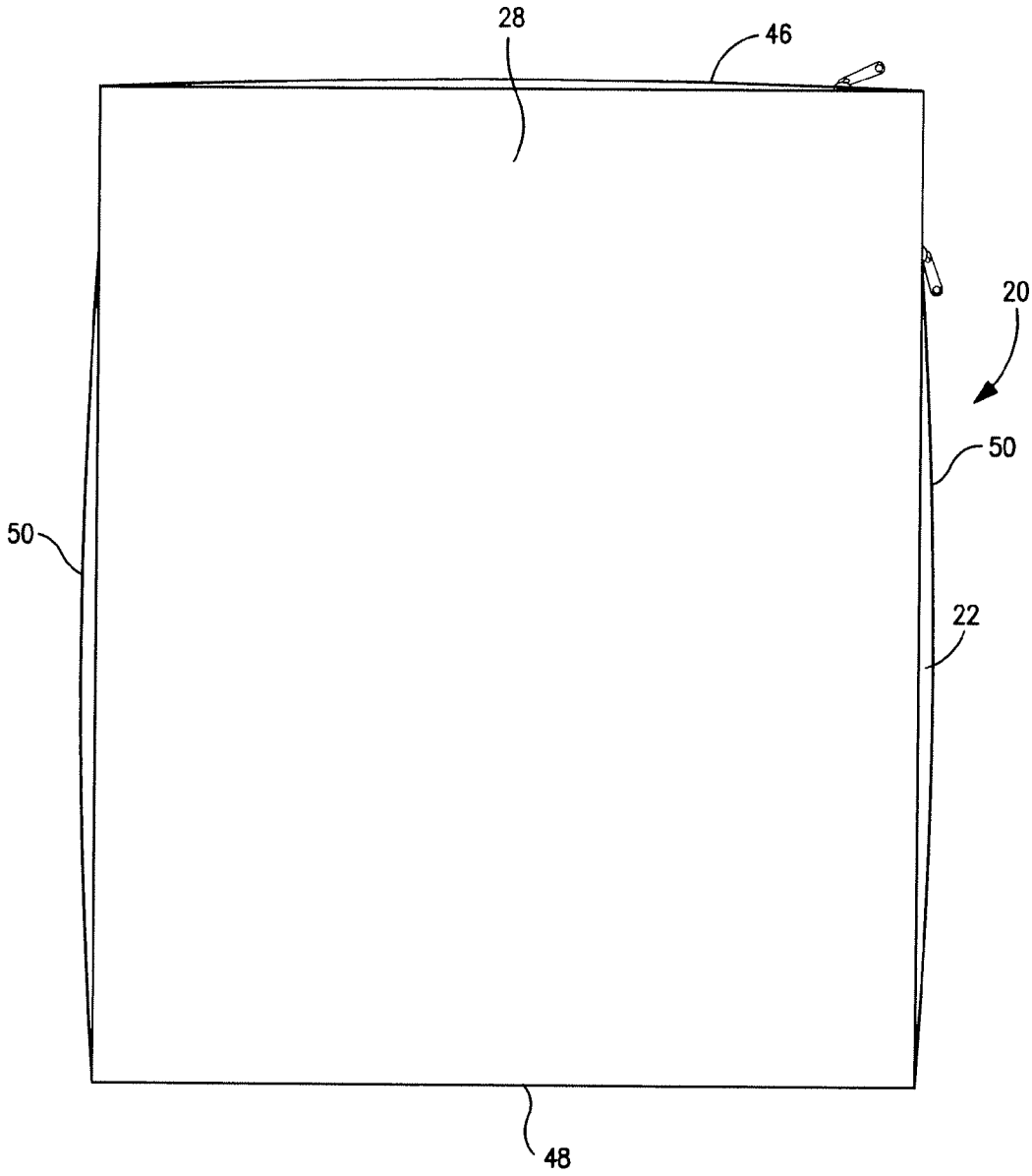
FIG. 2 is a rear view thereof.
Figure 10:
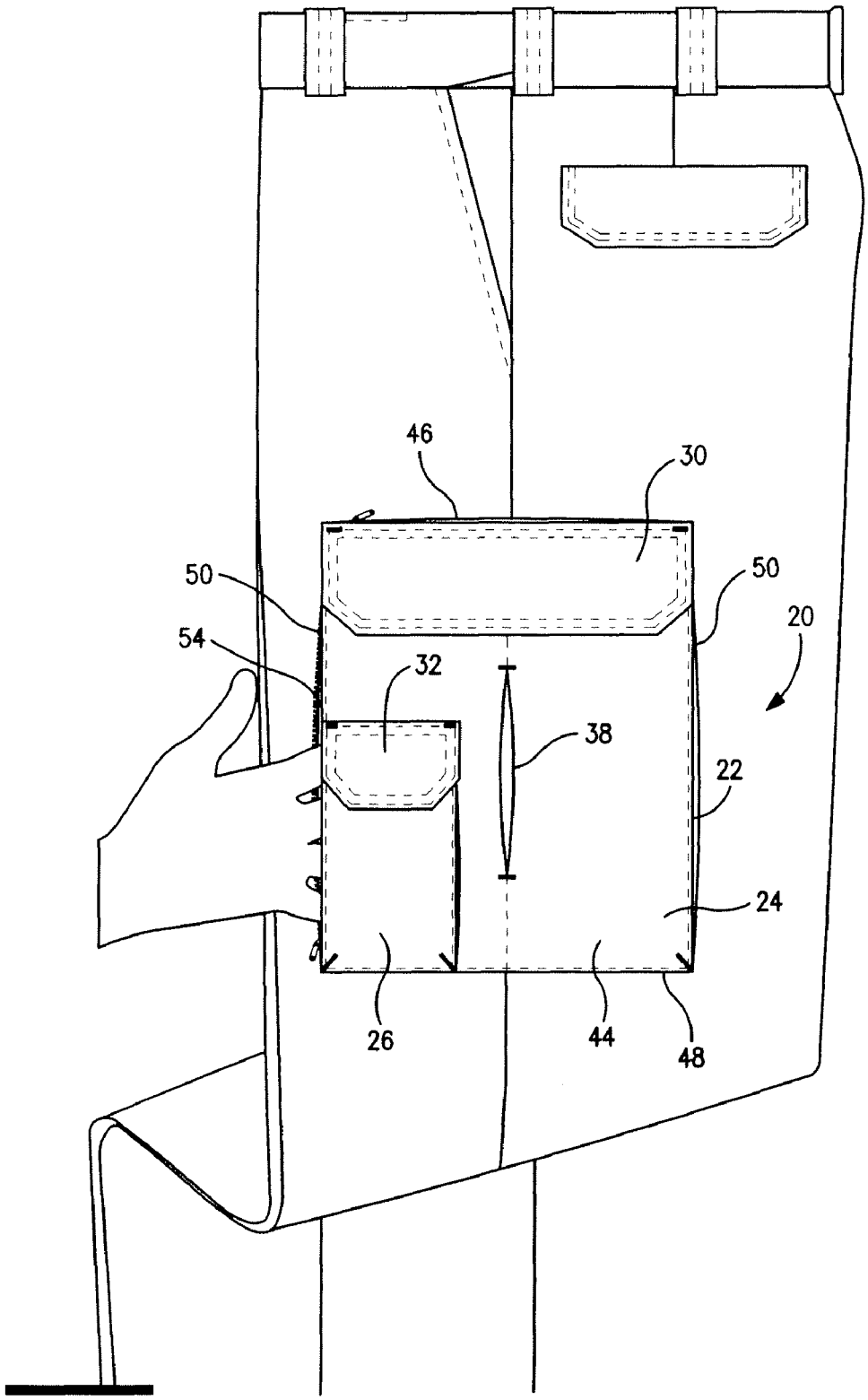
FIG. 10 is a front view thereof showing an open zipper to allow interior access a first pocket from the side attached to a pant leg.
Figure 11:
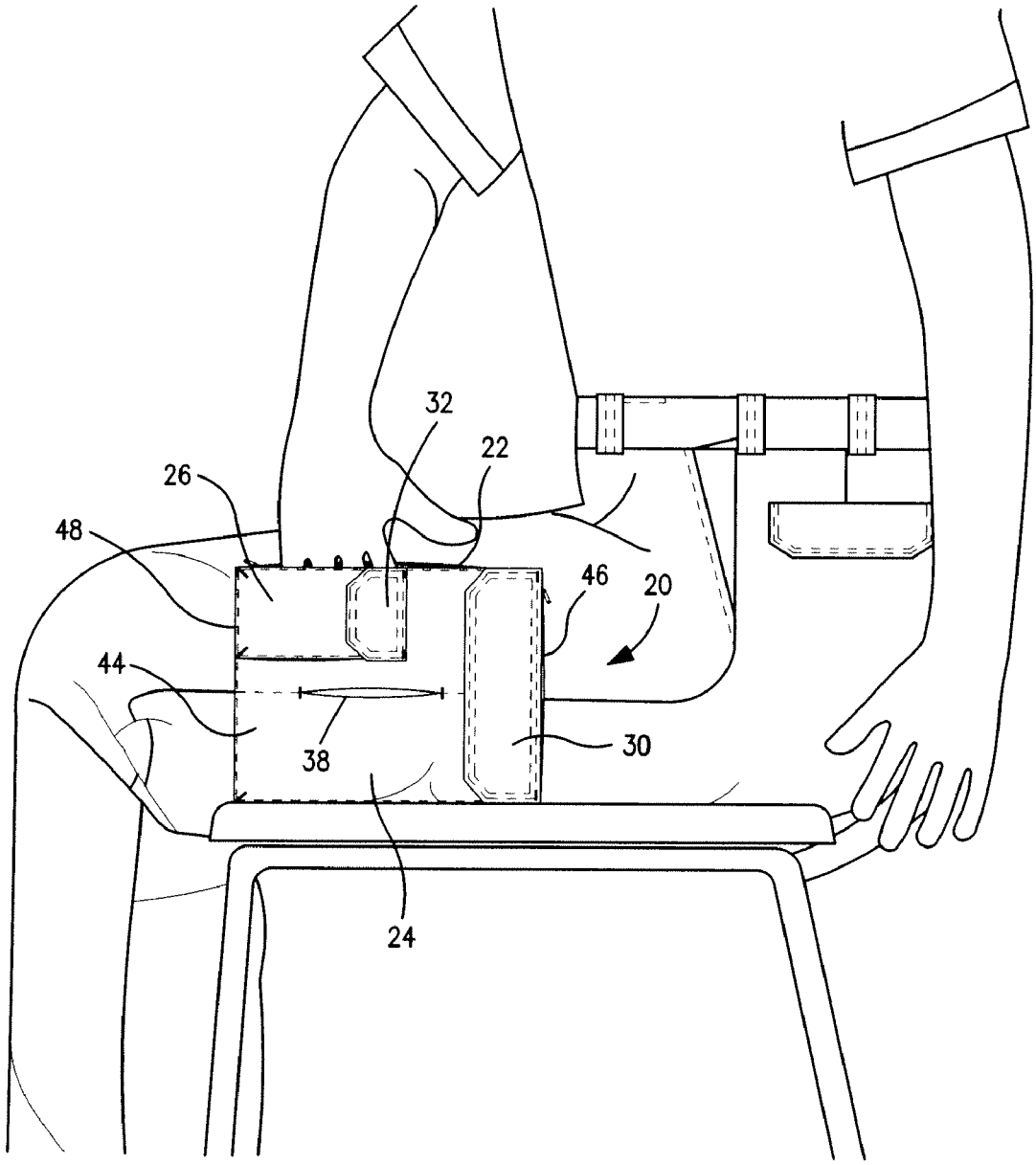
FIG. 11 is an additional front view thereof showing an open zipper to allow interior access a first pocket from the side attached to a pant leg of a seated person.
Figure 12:
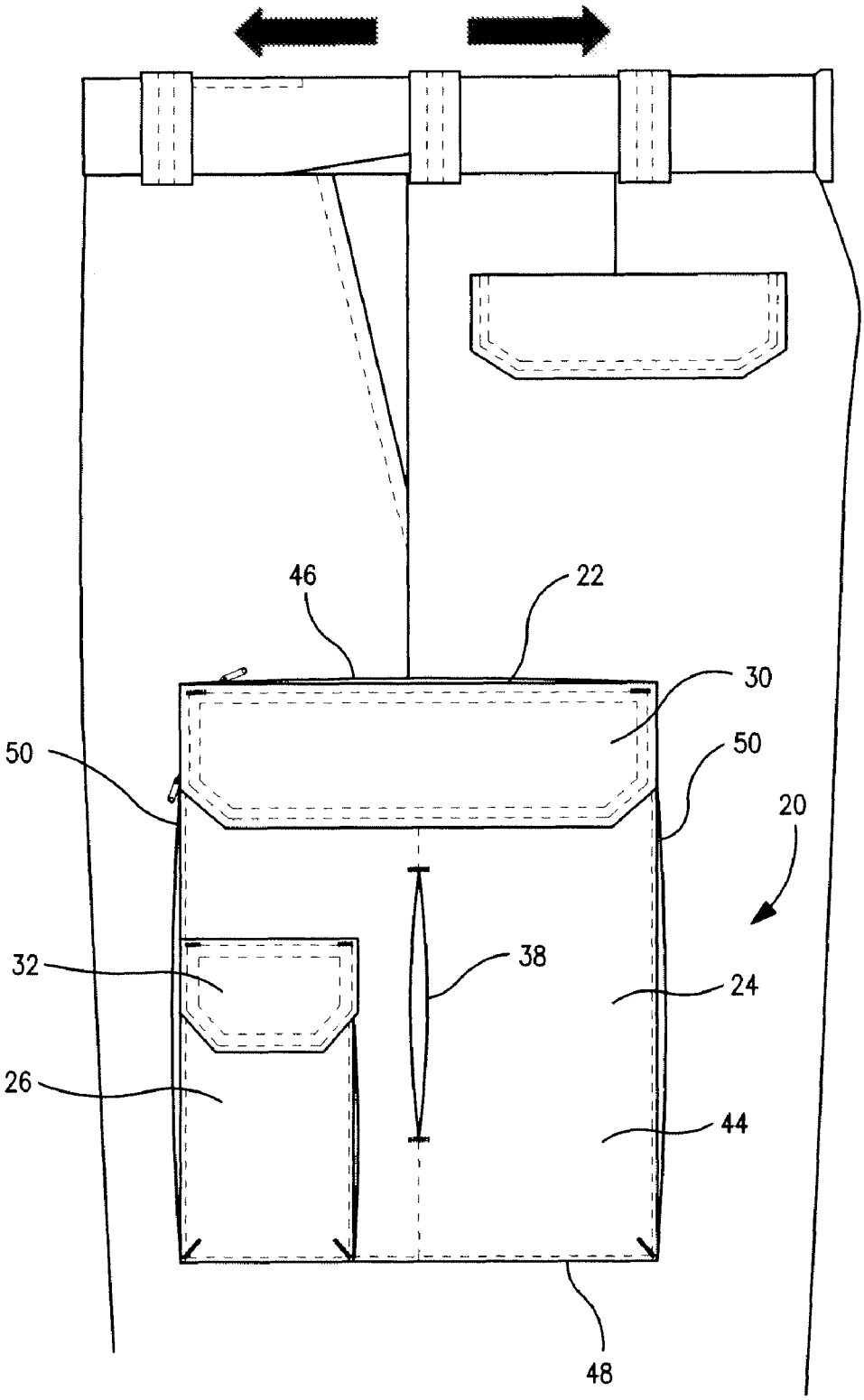
FIG. 12 is a front view thereof attached to an expandable pant leg.
Figure 13:
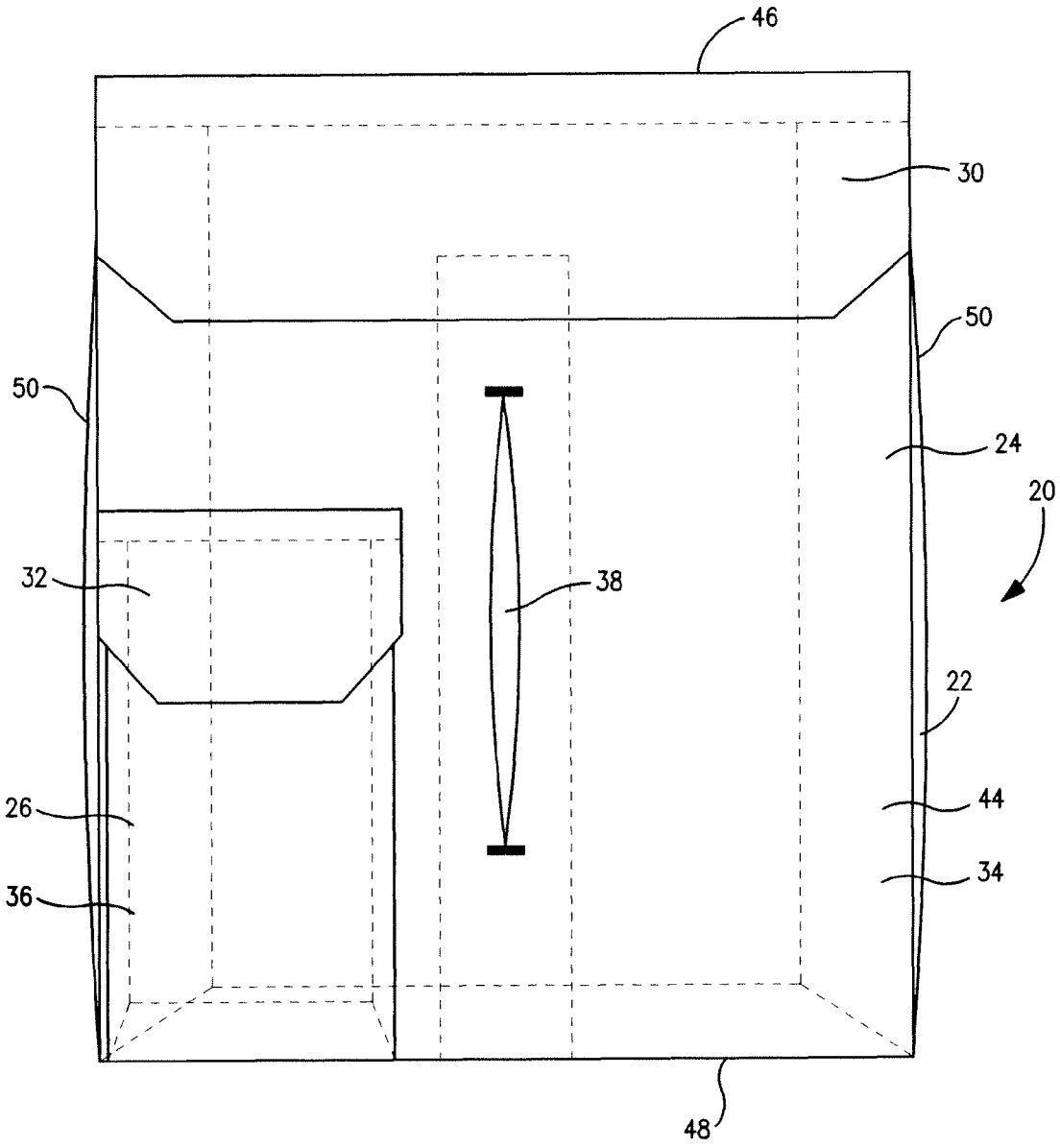
FIG. 13 is a front view thereof showing the hidden seams of a gusset and expanding pleats.

Turning now to the figures, FIG. 1 shows the pocket assembly has a plurality of pockets and is generally indicated at 20. Generally, pocket assembly 20 has an overall rectangular shape with its longitudinal length being somewhat larger than its lateral length, however, depending upon the particular articles to be carried, the pockets may be modified to meet the desired task. Pocket assembly 20 is designed to attach to any type of garment such as a shirt, coat, vest, jacket, pant leg, or the like. As illustrated in FIGS. 10-12, pocket assembly 20 is attached to a pant leg and has a particular advantage when placed on this type of garment (as described below). Pocket assembly 20 has a main pocket and two pocket sub-assemblies attached.

Figure 3:
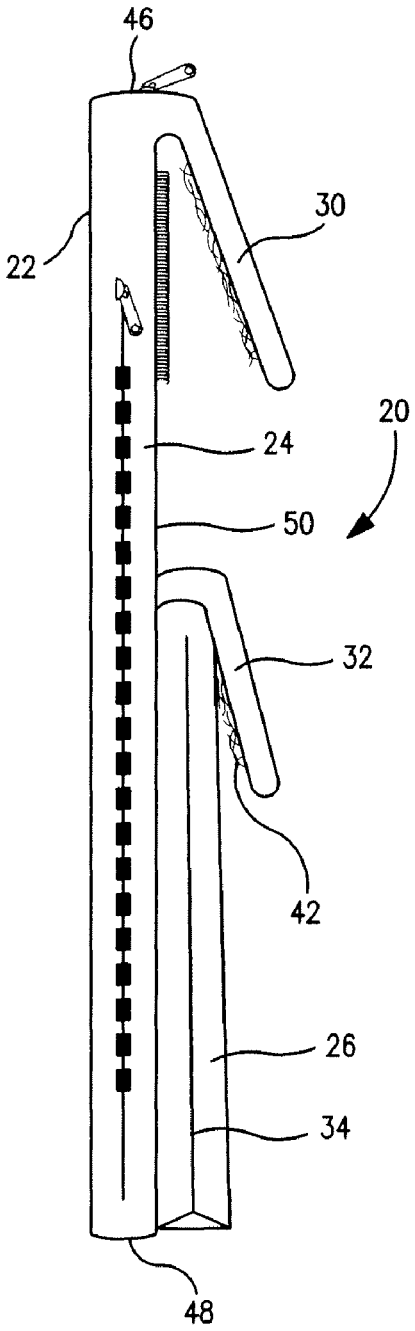
FIG. 3 is a left side view thereof.
Figure 4:
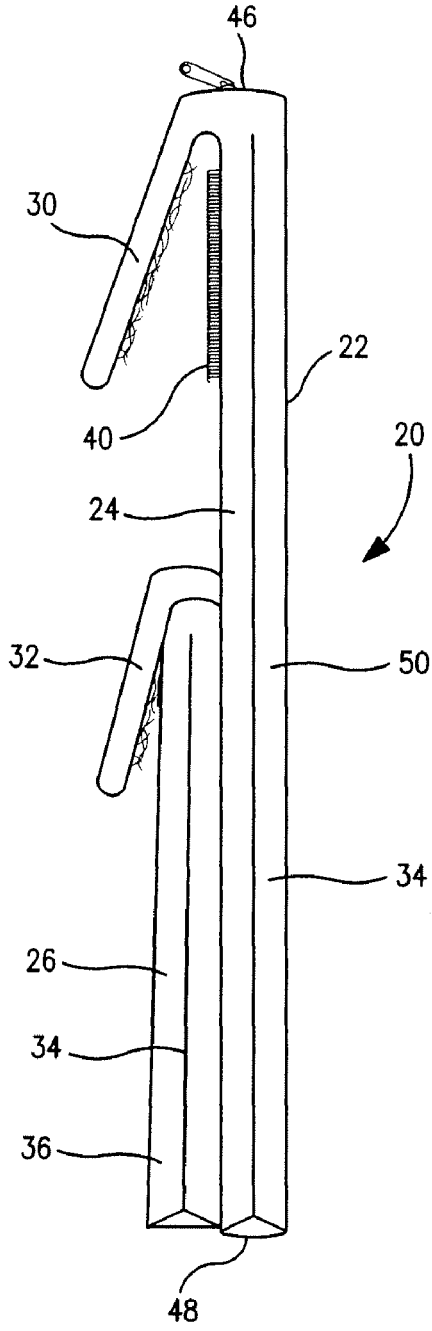
FIG. 4 is a right side view thereof.
Figure 5:
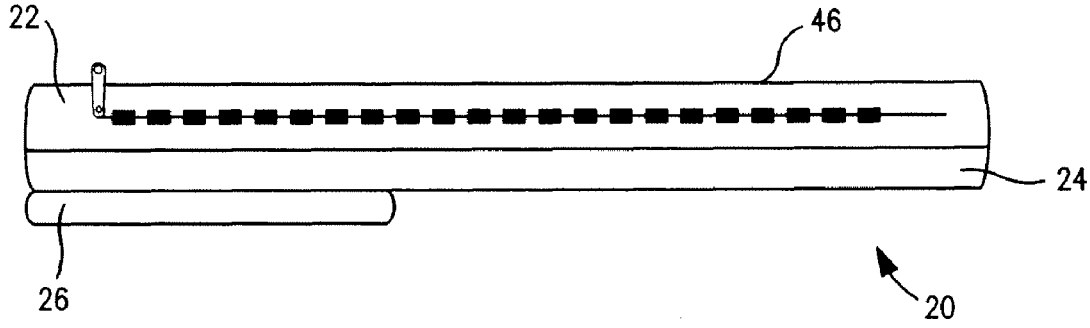
FIG. 5 is a top view thereof.
Figure 6:
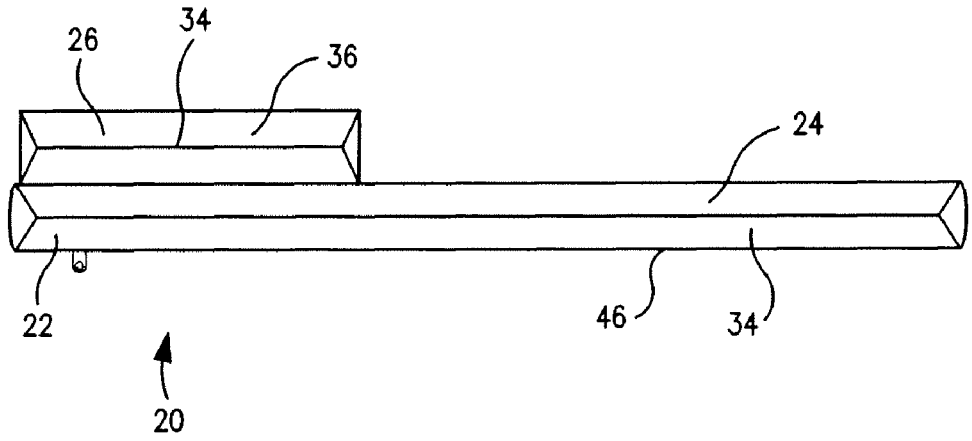
FIG. 6 is a rear view thereof.

Thus, a first main pocket assembly, and second and third pocket subassemblies are labeled 22, 24, and 26 respectively. The pockets are generally formed from a front panel and rear panel which are sewn together. As shown, the front panel of pocket 22 forms the rear panel of pocket 24. Similarly, the front panel of pocket 24 forms the rear panel of pocket 26. Flaps 30 and 32 cover the openings of the pockets 24 and 26 respectively and can be secured to the pockets by several means known in the art. As shown specifically in FIG. 7, a hook and loop fastening means (such as those sold under the trade name VELCRO), but other fastening means such as buttons, zippers, and the like are possible. As shown in FIGS. 4 and 6, both pockets 24 and 26 include pleats 34 and 36 respectively. These pleats enable the pockets to expand when carrying eyeglass cases cell phones, other portable electronic devices, and the like. As shown, pocket 24 further includes a gusset pleat 38 to allow for further expansion of the interior space of the pocket. Pocket 26, as shown, is configured to securely contain smaller items. With pleats 36, Flap 32 and hook and look fastening means 42 (FIG. 3) this pocket is ideal for carrying small electronic devices such as a cell phone.

Figure 8:
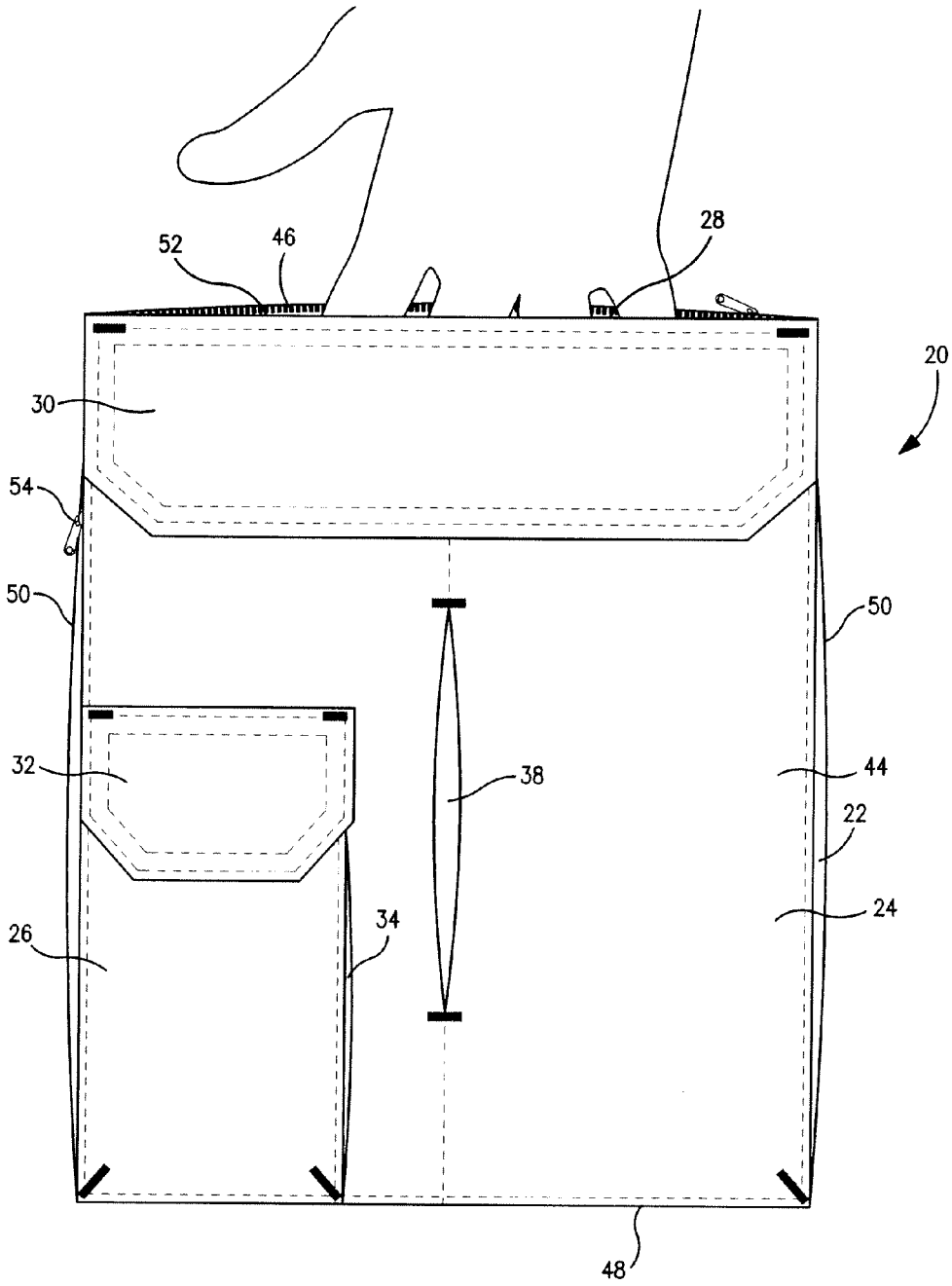
FIG. 8 is a front view thereof showing an open zipper to allow interior access a first pocket from the top.
Figure 9:
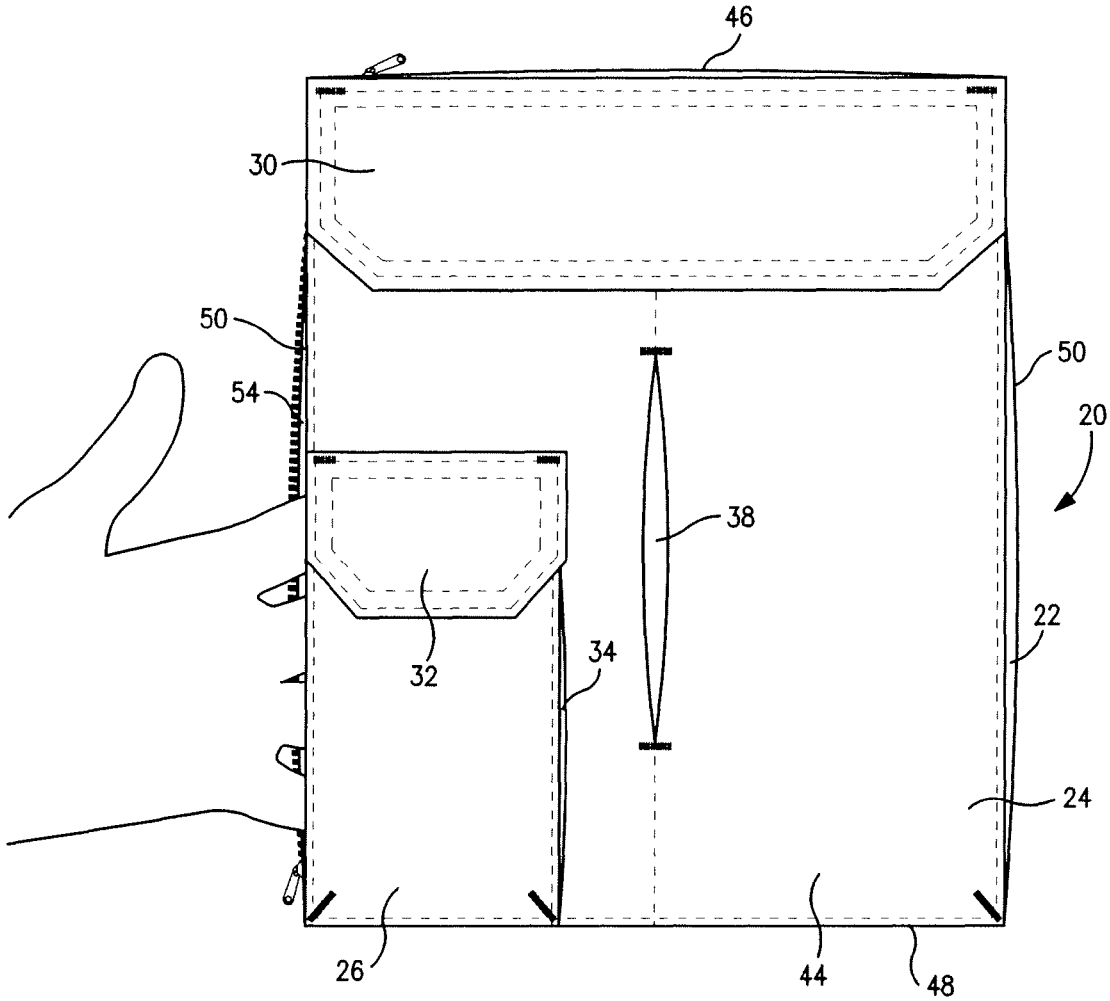
FIG. 9 is a front view thereof showing an open zipper to allow interior access a first pocket from the side.

As shown in FIG. 8, main pocket assembly 22 has separate rear panel 28 (or optionally could be formed from the garment itself), a front panel 24, a top side 46, a bottom side 48, and two vertical sides 50, said first pocket structure having at least two interior access openings with means for closing said topside 52 and at least one of said vertical sides 54. The means for closing the interior space can be any means known in the art, though zippers are shown. Hook and look fasteners, buttons, and the like could also be used. As shown, the interior of pocket assembly 22 can be accessed from at least two sides via access 52 and 54. This offers a significant advantage of the prior art in that the same pocket may be easily accessed while a user is in a seated (FIG. 11) or standing (FIG. 8) position.

Figure 7:
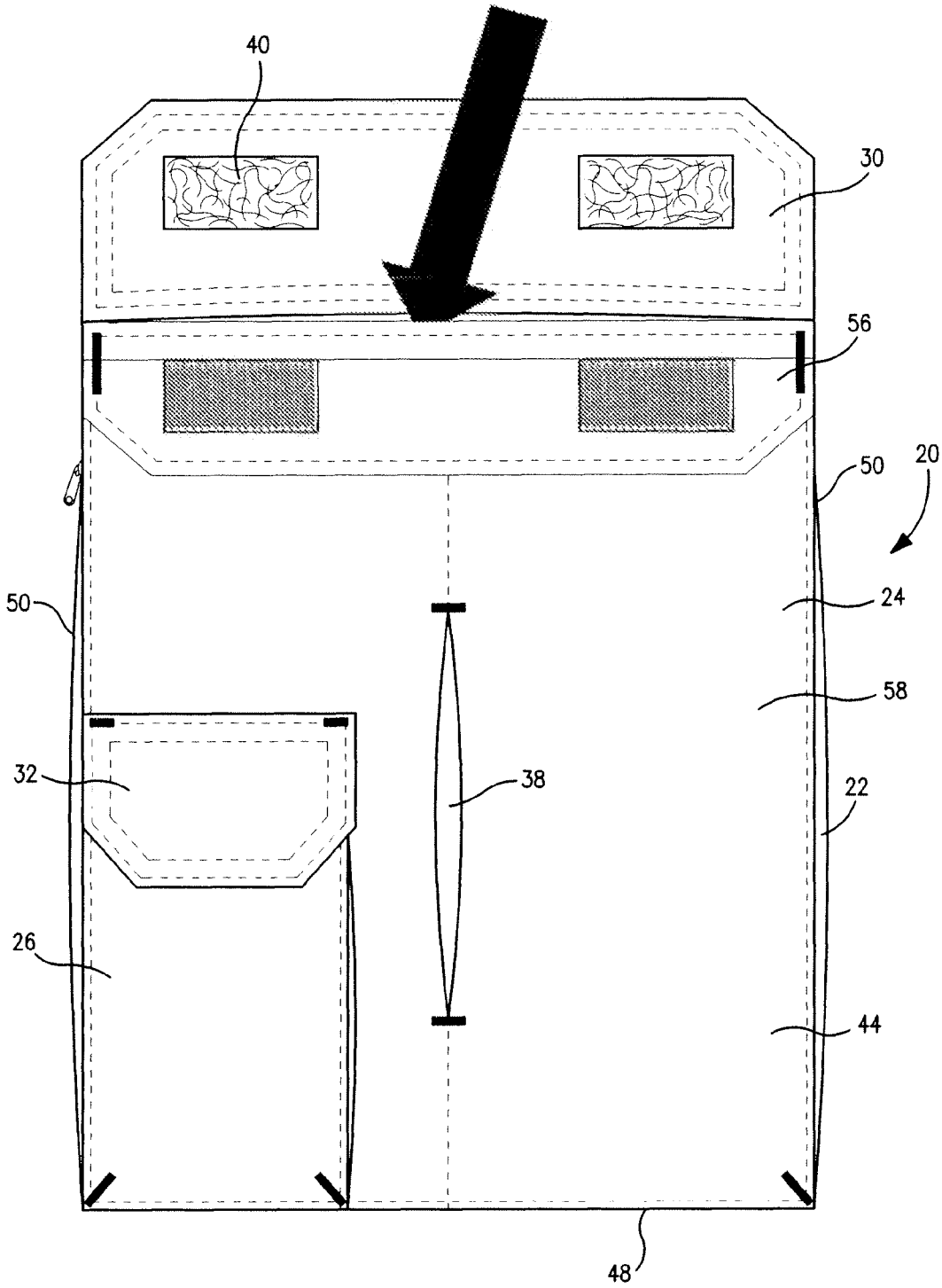
FIG. 7 is a front view thereof showing an open upper flap with loop and hook fastening means.

As shown in FIG. 7, pocket 24 can have a front panel 44 with an additional light reflecting, or other smooth surface 56, sewn under flap 32. This allows for a more rigid opening that is easy for a user to glide his hand under, provides an attractive appearance, and an added safety feature at night if the material is light reflecting.

While the invention has been described in conjunction with specific embodiments, it is evident that many alternatives, modifications, and variations will be apparent to those skilled in the art in light of the foregoing description. Accordingly, the present invention attempts to embrace all such alternatives, modifications, and variations that fall within the spirit and scope of the appended claims.

What is claimed is:

1. A multi-pocket assembly attachable to a garment, comprising:

a first pocket structure having a front, a top side, a bottom side, and two vertical sides, said first pocket structure having at least two interior access openings with means for closing on said topside and at least one of said vertical sides;

the first pocket structure having a second interior access opening on the top side, and a flap to cover said second interior access opening; and a second pocket structure attached to the front of said first pocket, having a second top side, second vertical sides, second bottom side, having an third interior access opening on the second top side, and a second flap to cover said third interior access opening, said second pocket structure smaller in size to said first pocket structure.

2. The multi-pocket assembly of claim 1, wherein said garment is a pant leg.

3. The multi-pocket assembly of claim 1, wherein said first pocket structure further comprises a light reflective surface attached to said front, whereby rigidity is added to the front of said first pocket.

4. The multi-pocket assembly of claim 3, wherein said securing means is a hook and loop fastener.

5. The multi-pocket assembly of claim 1, further comprising a securing means of said first and second flaps to said fronts of said first and second pocket structures respectively.

6. The multi-pocket assembly of claim 1, wherein said closing means comprises a zipper.

7. The multi-pocket assembly of claim 1, wherein said interior access opening with means for closing is on both vertical sides of said first pocket structure.

8. The multi-pocket assembly of claim 1, wherein said first front further comprises a gusset pleat, whereby an interior volume of said first pocket is increased.

9. The multi-pocket assembly of claim 1, wherein said first pocket structure has pleats on said first vertical sides and said first bottom side.

10. The multi-pocket assembly of claim 1, wherein said second pocket structure has pleats on said second vertical sides and said second bottom side.

11. A garment, comprising:

a pair of pant legs;

a first pocket structure having a front, a top side, a bottom side, and two vertical sides, said first pocket structure having at least two interior access openings with means for closing on said topside and at least one of said vertical sides;

the first pocket structure having a second interior access opening on the top side, and a flap to cover said second interior access opening; and a second pocket structure attached to the front of said first pocket, having a second top side, second vertical sides, second bottom side, having a third interior access opening on the second top side, and a second flap to cover said third interior access opening, said second pocket structure smaller in size to said first pocket structure.

12. The garment of claim 11, wherein said garment has an expandable waist.

* * * * *